US010766272B2

(12) United States Patent
Govyadinov et al.

(10) Patent No.: US 10,766,272 B2
(45) Date of Patent: Sep. 8, 2020

(54) FLUID EJECTION DEVICE

(71) Applicant: HEWLETT-PACKARD DEVELOPMENT COMPANY, L.P., Houston, TX (US)

(72) Inventors: Alexander Govyadinov, Corvallis, OR (US); Tommy D Deskins, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/217,140

(22) Filed: Dec. 12, 2018

(65) Prior Publication Data

US 2019/0111699 A1 Apr. 18, 2019

Related U.S. Application Data

(63) Continuation of application No. 15/521,286, filed as application No. PCT/US2014/063369 on Oct. 31, 2014, now Pat. No. 10,183,493.

(51) Int. Cl.

| | |
|---|---|
| ***B41J 2/18*** | (2006.01) |
| ***B41J 2/175*** | (2006.01) |
| ***B41J 2/14*** | (2006.01) |

(52) U.S. Cl.

CPC ..... *B41J 2/18* (2013.01); *B41J 2/1404* (2013.01); *B41J 2/14056* (2013.01); *B41J 2/175* (2013.01); *B41J 2002/14467* (2013.01); *B41J 2202/12* (2013.01)

(58) Field of Classification Search

CPC ..... B41J 2/18; B41J 2/14056; B41J 2/1404; B41J 1/175; B41J 2202/12; B41J 2002/14467

See application file for complete search history.

(56) References Cited

U.S. PATENT DOCUMENTS

| | | | |
|---|---|---|---|
| 5,818,485 | A | 10/1998 | Rezanka |
| 6,880,926 | B2 | 4/2005 | Childs et al. |
| 7,040,745 | B2 | 5/2006 | Kent |
| 7,448,741 | B2 | 11/2008 | von Essen |
| 8,540,355 | B2 | 9/2013 | Govyadinov |
| 8,814,293 | B2 | 8/2014 | Strunk et al. |
| 8,820,899 | B2 | 9/2014 | Hoisington et al. |
| 2004/0085417 | A1 | 5/2004 | Childs |
| 2008/0055378 | A1 | 3/2008 | Drury et al. |
| 2013/0083136 | A1 | 4/2013 | Govyadinov |
| 2013/0155135 | A1 | 6/2013 | Govyadinov et al. |

(Continued)

FOREIGN PATENT DOCUMENTS

| | | |
|---|---|---|
| CN | 103153627 A | 6/2013 |
| CN | 103640336 A | 3/2014 |

(Continued)

OTHER PUBLICATIONS

StarFire SG1024/MC, https://www.fujifilmusa.com/shared/bin/PDS00078_10302013.pdf.

*Primary Examiner* — Sharon A. Polk

(74) *Attorney, Agent, or Firm* — Rathe Lindenbaum LLP

(57) ABSTRACT

A fluid ejection device may include a series of spaced two-sided walls forming three channels therebetween. Each of the three channels may contain a drop ejector. The device may further include a fluid circulating element to circulate fluid across the drop ejector within each of the channels.

20 Claims, 7 Drawing Sheets

(56) References Cited

U.S. PATENT DOCUMENTS

| | | | | |
|---|---|---|---|---|
| 2013/0155152 | A1 | 6/2013 | Govyadinov | |
| 2013/0169710 | A1 | 7/2013 | Keefe et al. | |
| 2013/0321541 | A1 | 12/2013 | Govyadinov | |
| 2017/0305169 | A1* | 10/2017 | Govyadinov | ..... B41J 2/175 |

FOREIGN PATENT DOCUMENTS

| | | | |
|---|---|---|---|
| TW | 200406315 | A | 5/2004 |
| WO | WO-2013130039 | A1 | 9/2013 |
| WO | WO-2013162606 | | 10/2013 |

* cited by examiner

FLUID EJECTION DEVICE

CROSS-REFERENCE TO RELATED PATENT APPLICATIONS

The present application is a continuation application claiming priority under 35 USC § 120 from U.S. patent application Ser. No. 15/521,286, filed Apr. 22, 2017, which is a US National Application claiming domestic benefit from PCT/US2014/63369, filed Oct. 31, 2014, each of which is incorporated herein by reference.

BACKGROUND

Fluid ejection devices, such as printheads in inkjet printing systems, may use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead and the print medium move relative to each other.

Decap is the amount of time inkjet nozzles can remain uncapped and exposed to ambient conditions without causing degradation in ejected ink drops. Effects of decap can alter drop trajectories, velocities, shapes and colors, all of which can negatively impact print quality. Other factors related to decap, such as evaporation of water or solvent, can cause pigment-ink vehicle separation (PIVS) and viscous plug formation. For example, during periods of storage or non-use, pigment particles can settle or "crash" out of the ink vehicle which can impede or block ink flow to the ejection chambers and nozzles.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

The present disclosure helps to reduce ink blockage and/or clogging in inkjet printing systems generally by circulating (or recirculating) fluid through fluid ejection chambers. Fluid circulates (or recirculates) through fluidic channels that include fluid circulating elements or actuators to pump or circulate the fluid.

Figure 1:
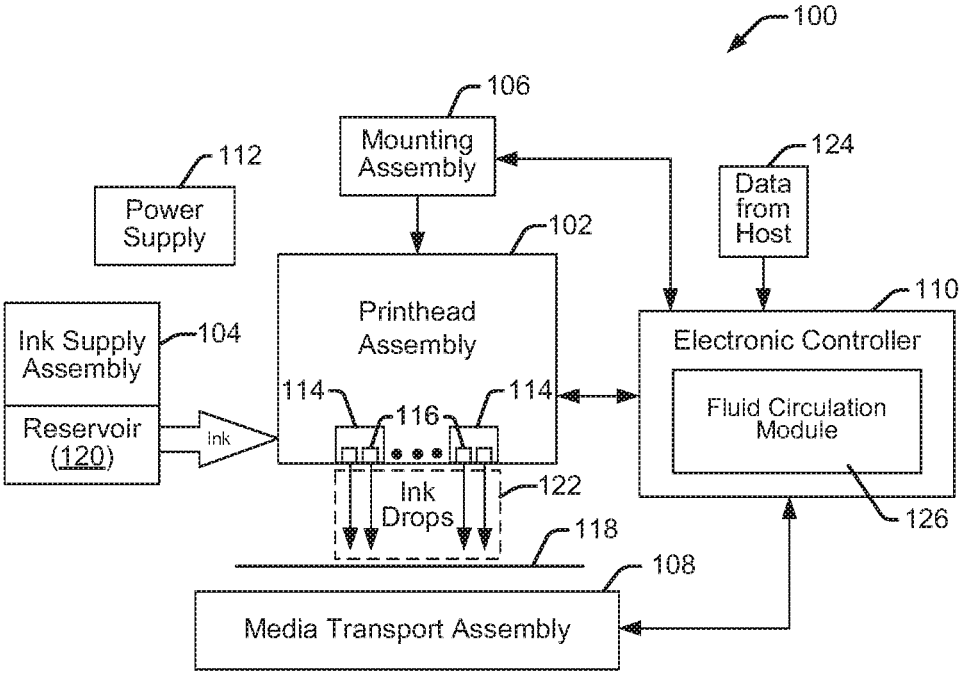
FIG. 1 is a block diagram illustrating one example of an inkjet printing system including an example of a fluid ejection device.

FIG. 1 illustrates one example of an inkjet printing system as an example of a fluid ejection device with fluid circulation, as disclosed herein. Inkjet printing system 100 includes a printhead assembly 102, an ink supply assembly 104, a mounting assembly 106, a media transport assembly 108, an electronic controller 110, and at least one power supply 112 that provides power to the various electrical components of inkjet printing system 100. Printhead assembly 102 includes at least one fluid ejection assembly 114 (printhead 114) that ejects drops of ink through a plurality of orifices or nozzles 116 toward a print medium 118 so as to print on print media 118.

Print media 118 can be any type of suitable sheet or roll material, such as paper, card stock, transparencies, Mylar, and the like. Nozzles 116 are typically arranged in one or more columns or arrays such that properly sequenced ejection of ink from nozzles 116 causes characters, symbols, and/or other graphics or images to be printed on print media 118 as printhead assembly 102 and print media 118 are moved relative to each other.

Ink supply assembly 104 supplies fluid ink to printhead assembly 102 and, in one example, includes a reservoir 120 for storing ink such that ink flows from reservoir 120 to printhead assembly 102. Ink supply assembly 104 and printhead assembly 102 can form a one-way ink delivery system or a recirculating ink delivery system. In a one-way ink delivery system, substantially all of the ink supplied to printhead assembly 102 is consumed during printing. In a recirculating ink delivery system, only a portion of the ink supplied to printhead assembly 102 is consumed during printing. Ink not consumed during printing is returned to ink supply assembly 104.

In one example, printhead assembly 102 and ink supply assembly 104 are housed together in an inkjet cartridge or pen. In another example, ink supply assembly 104 is separate from printhead assembly 102 and supplies ink to printhead assembly 102 through an interface connection, such as a supply tube. In either example, reservoir 120 of ink supply assembly 104 may be removed, replaced, and/or refilled. Where printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions printhead assembly 102 relative to media transport assembly 108, and media transport assembly 108 positions print media 118 relative to printhead assembly 102. Thus, a print zone 122 is defined adjacent to nozzles 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108. Thus, media transport assembly 108 positions print media 118 relative to printhead assembly 102.

Electronic controller 110 typically includes a processor, firmware, software, one or more memory components including volatile and no-volatile memory components, and other printer electronics for communicating with and controlling printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example, electronic controller 110 controls printhead assembly 102 for ejection of ink drops from nozzles 116. Thus, electronic controller 110 defines a pattern of ejected ink drops which form characters, symbols, and/or other graphics or images on print media 118. The pattern of ejected ink drops is determined by the print job commands and/or command parameters.

Printhead assembly 102 includes one or more printheads 114. In one example, printhead assembly 102 is a wide-array or multi-head printhead assembly. In one implementation of a wide-array assembly, printhead assembly 102 includes a carrier that carries a plurality of printheads 114, provides electrical communication between printheads 114 and electronic controller 110, and provides fluidic communication between printheads 114 and ink supply assembly 104.

In one example, inkjet printing system 100 is a drop-on-demand thermal inkjet printing system wherein printhead 114 is a thermal inkjet (TIJ) printhead. The thermal inkjet printhead implements a thermal resistor ejection element in an ink chamber to vaporize ink and create bubbles that force ink or other fluid drops out of nozzles 116. In another example, inkjet printing system 100 is a drop-on-demand piezoelectric inkjet printing system wherein printhead 114 is a piezoelectric inkjet (PIJ) printhead that implements a piezoelectric material actuator as an ejection element to generate pressure pulses that force ink drops out of nozzles 116.

In one example, electronic controller 110 includes a flow circulation module 126 stored in a memory of controller 110. Flow circulation module 126 executes on electronic controller 110 (i.e., a processor of controller 110) to control the operation of one or more fluid actuators integrated as pump elements within printhead assembly 102 to control circulation of fluid within printhead assembly 102.

Figure 2:
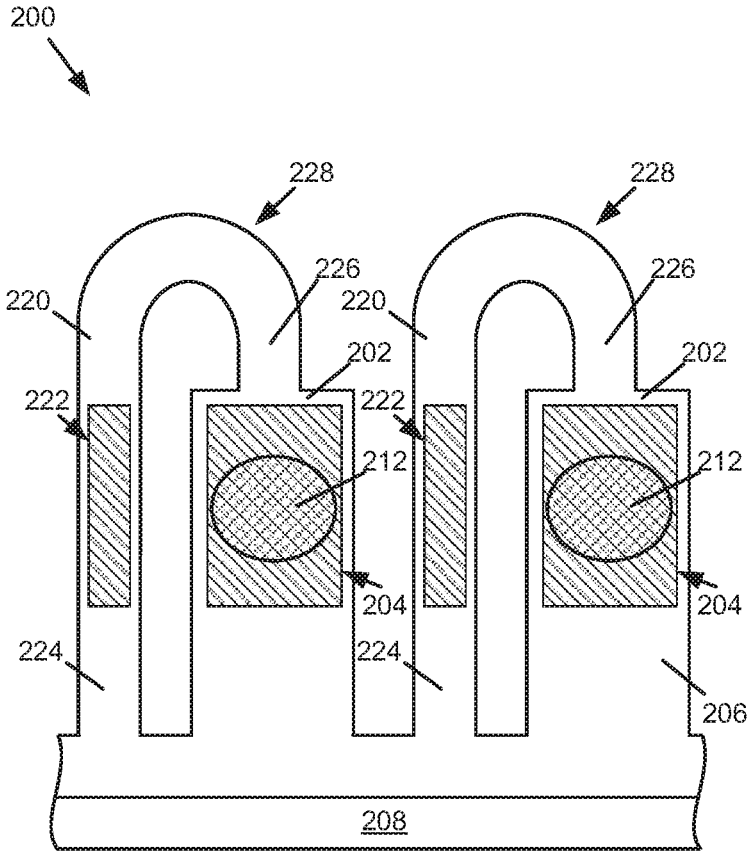
FIG. 2 is a schematic plan view illustrating one example of a portion of a fluid ejection device.

FIG. 2 is a schematic plan view illustrating one example of a portion of a fluid ejection device 200. Fluid ejection device 200 includes a fluid ejection chamber 202 and a corresponding drop ejecting element 204 formed or provided within fluid ejection chamber 202. Fluid ejection chamber 202 and drop ejecting element 204 are formed on a substrate 206 which has a fluid (or ink) feed slot 208 formed therein such that fluid feed slot 208 provides a supply of fluid (or ink) to fluid ejection chamber 202 and drop ejecting element 204. Substrate 206 may be formed, for example, of silicon, glass, or a stable polymer.

In one example, fluid ejection chamber 202 is formed in or defined by a barrier layer (not shown) provided on substrate 206, such that fluid ejection chamber 202 provides a "well" in the barrier layer. The barrier layer may be formed, for example, of a photoimageable epoxy resin, such as SU8.

In one example, a nozzle or orifice layer (not shown) is formed or extended over the barrier layer such that a nozzle opening or orifice 212 formed in the orifice layer communicates with a respective fluid ejection chamber 202. Nozzle opening or orifice 212 may be of a circular, non-circular, or other shape.

Drop ejecting element 204 can be any device capable of ejecting fluid drops through corresponding nozzle opening or orifice 212. Examples of drop ejecting element 204 include a thermal resistor or a piezoelectric actuator. A thermal resistor, as an example of a drop ejecting element, is typically formed on a surface of a substrate (substrate 206), and includes a thin-film stack including an oxide layer, a metal layer, and a passivation layer such that, when activated, heat from the thermal resistor vaporizes fluid in fluid ejection chamber 202, thereby causing a bubble that ejects a drop of fluid through nozzle opening or orifice 212. A piezoelectric actuator, as an example of a drop ejecting element, generally includes a piezoelectric material provided on a moveable membrane communicated with fluid ejection chamber 202 such that, when activated, the piezoelectric material causes deflection of the membrane relative to fluid ejection chamber 202, thereby generating a pressure pulse that ejects a drop of fluid through nozzle opening or orifice 212.

As illustrated in the example of FIG. 2, fluid ejection device 200 includes a fluid circulation channel 220 and a fluid circulating element 222 formed in, provided within, or communicated with fluid circulation channel 220. Fluid circulation channel 220 is open to and communicates at one end 224 with fluid feed slot 208 and communicates at another end 226 with fluid ejection chamber 202 such that fluid from fluid feed slot 208 circulates (or recirculates) through fluid circulation channel 220 and fluid ejection chamber 202 based on flow induced by fluid circulating element 222. In one example, fluid circulation channel 220 includes a channel loop portion 228 such that fluid in fluid circulation channel 220 circulates (or recirculates) through channel loop portion 228 between fluid feed slot 208 and fluid ejection chamber 202.

As illustrated in the example of FIG. 2, fluid circulation channel 220 communicates with one (i.e., a single) fluid ejection chamber 202. As such, fluid ejection device 200 has a 1:1 nozzle-to-pump ratio, where fluid circulating element 222 is referred to as a "pump" which induces fluid flow through fluid circulation channel 220 and fluid ejection chamber 202. With a 1:1 ratio, circulation is individually provided for each fluid ejection chamber 202.

In the example illustrated in FIG. 2, drop ejecting element 204 and fluid circulating element 222 are both thermal resistors. Each of the thermal resistors may include, for example, a single resistor, a split resistor, a comb resistor, or multiple resistors. A variety of other devices, however, can also be used to implement drop ejecting element 204 and fluid circulating element 222 including, for example, a piezoelectric actuator, an electrostatic (MEMS) membrane, a mechanical/impact driven membrane, a voice coil, a magneto-strictive drive, and so on.

Figure 3:
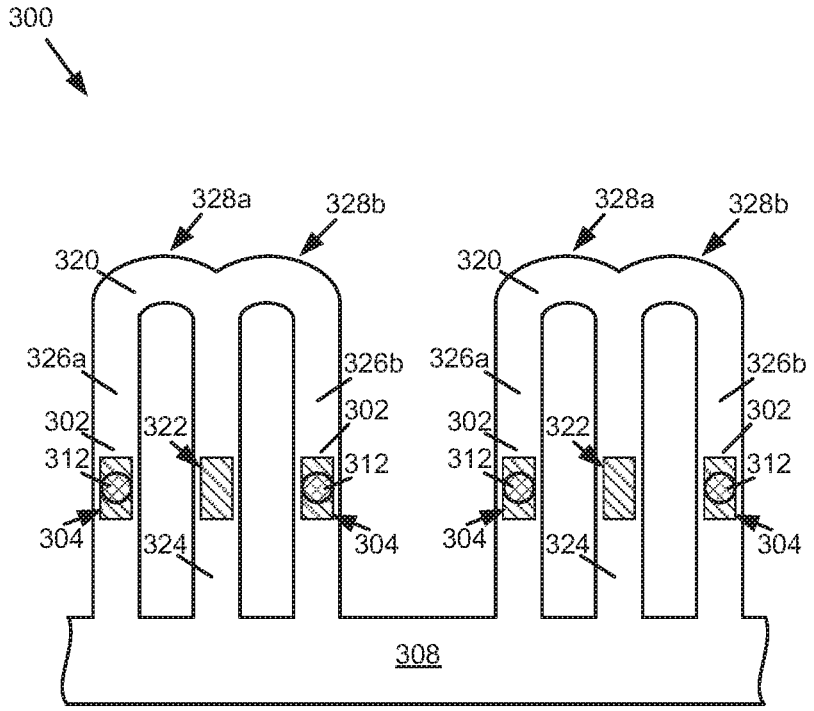
FIG. 3 is a schematic plan view illustrating another example of a portion of a fluid ejection device.

FIG. 3 is a schematic plan view illustrating another example of a portion of a fluid ejection device 300. Fluid ejection device 300 includes a plurality of fluid ejection chambers 302 and a plurality of fluid circulation channels 320. Similar to that described above, fluid ejection chambers 302 each include a drop ejecting element 304 with a corresponding nozzle opening or orifice 312, and fluid circulation channels 320 each include a fluid circulating element 322.

In the example illustrated in FIG. 3, fluid circulation channels 320 each are open to and communicate at one end 324 with fluid feed slot 308 and communicate at another end, for example, ends 326*a*, 326*b*, with multiple fluid ejection chambers 302 (i.e., more than one fluid ejection chamber). In one example, fluid circulation channels 320 include a plurality of channel loop portions, for example, channel loop portions 328*a*, 328*b*, each communicated with a different fluid ejection chamber 302 such that fluid from fluid feed slot 308 circulates (or recirculates) through fluid circulation channels 320 (including channel loop portions 328*a*, 328*b*) and the associated fluid ejection chambers 302 based on flow induced by a corresponding fluid circulating element 322.

As illustrated in the example of FIG. 3, fluid circulation channels 320 each communicate with two fluid ejection chambers 302. As such, fluid ejection device 300 has a 2:1 nozzle-to-pump ratio, where fluid circulating element 322 is referred to as a "pump" which induces fluid flow through a corresponding fluid circulation channel 320 and associated fluid ejection chambers 302. Other nozzle-to-pump ratios (e.g., 3:1, 4:1, etc.) are also possible.

Figure 4:
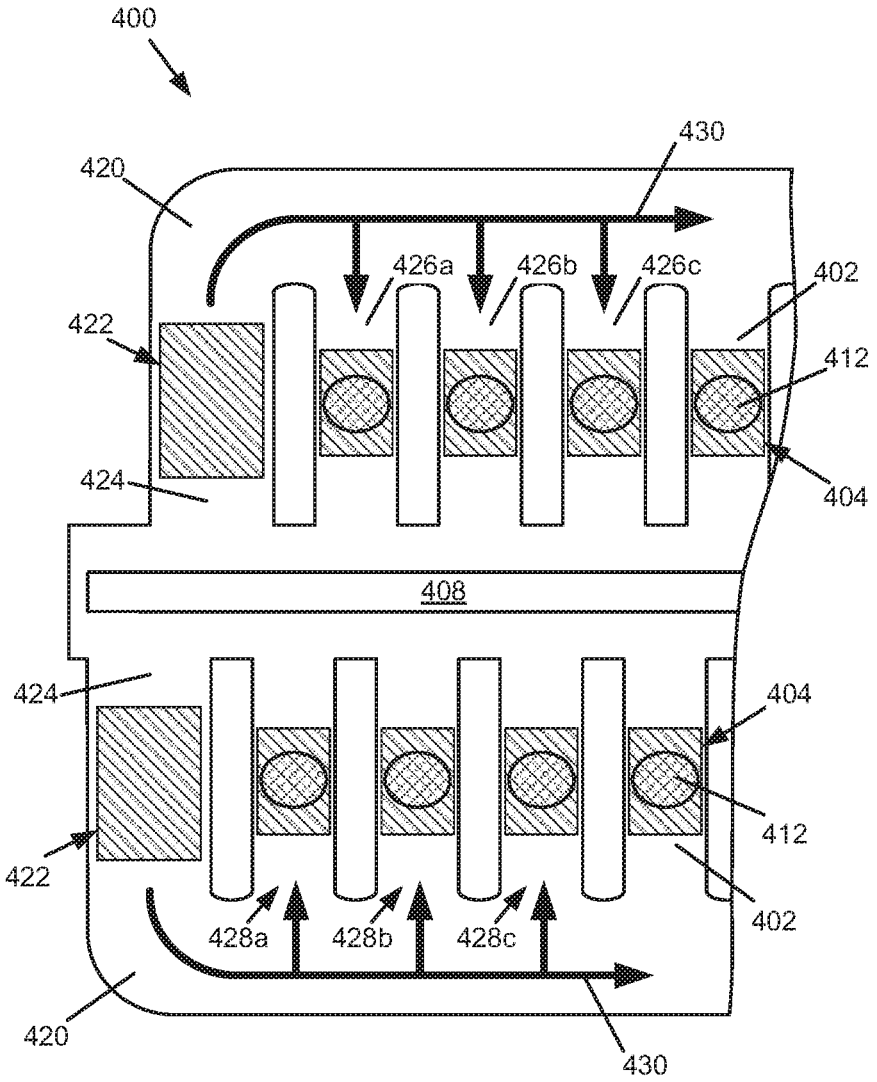
FIG. 4 is a schematic plan view illustrating another example of a portion of a fluid ejection device.

FIG. 4 is a schematic plan view illustrating another example of a portion of a fluid ejection device 400. Fluid ejection device 400 includes a plurality of fluid ejection chambers 402 and a plurality of fluid circulation channels 420. Similar to that described above, fluid ejection chambers 402 each include a drop ejecting element 404 with a corresponding nozzle opening or orifice 412, and fluid circulation channels 420 each include a fluid circulating element 422.

In the example illustrated in FIG. 4, fluid circulation channels 420 each are open to and communicate at one end 424 with fluid feed slot 408 and communicate at another end, for example, ends 426*a*, 426*b*, 426*c* . . . , with multiple fluid ejection chambers 402. In one example, fluid circulation channels 420 include a plurality of channel loop portions 428*a*, 428*b*, 428*c* . . . each communicated with a fluid ejection chamber 402 such that fluid from fluid feed slot 408 circulates (or recirculates) through fluid circulation channels 420 (including channel loop portions 428*a*, 428*b*, 428*c* . . . ) and the associated fluid ejection chambers 402 based on flow induced by a corresponding fluid circulating element 422. Such flow is represented in FIG. 4 by arrows 430.

Figure 5:
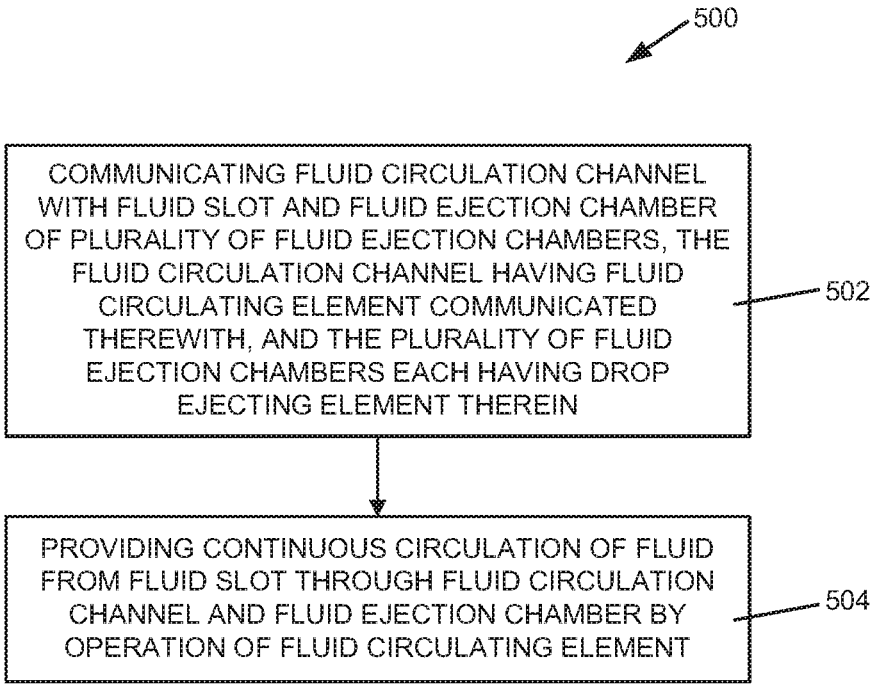
FIG. 5 is a flow diagram illustrating one example of a method of operating a fluid ejection device.

FIG. 5 is a flow diagram illustrating one example of a method 500 of operating a fluid ejection device, such as fluid ejection devices 200, 300, and 400 as described above and illustrated in the examples of FIGS. 2, 3, and 4.

At 502, method 500 includes communicating a fluid circulation channel, such as fluid circulation channels 220, 320, and 420, with a fluid slot, such as fluid feed slots 208, 308, and 408, and at least one fluid ejection chamber of a plurality of fluid ejection chambers, such as fluid ejection chambers 202, 302, and 402. The fluid circulation channel, such as fluid circulation channels 220, 320, and 420, has a fluid circulating element, such as fluid circulating elements 222, 322, and 422, communicated therewith, and the plurality of fluid ejection chambers, such as fluid ejection chambers 202, 302, and 402, each have one of a plurality of drop ejecting elements, such as drop ejecting elements 204, 304, and 404, therein.

At 504, method 500 includes providing continuous circulation of fluid from the fluid slot, such as fluid feed slots 208, 308, and 408, through the fluid circulation channel, such as fluid circulation channels 220, 320, and 420, and the at least one fluid ejection chamber, such as fluid ejection chambers 202, 302, and 402, by operation of the fluid circulating element, such as fluid circulating elements 222, 322, and 422.

Figure 6A:
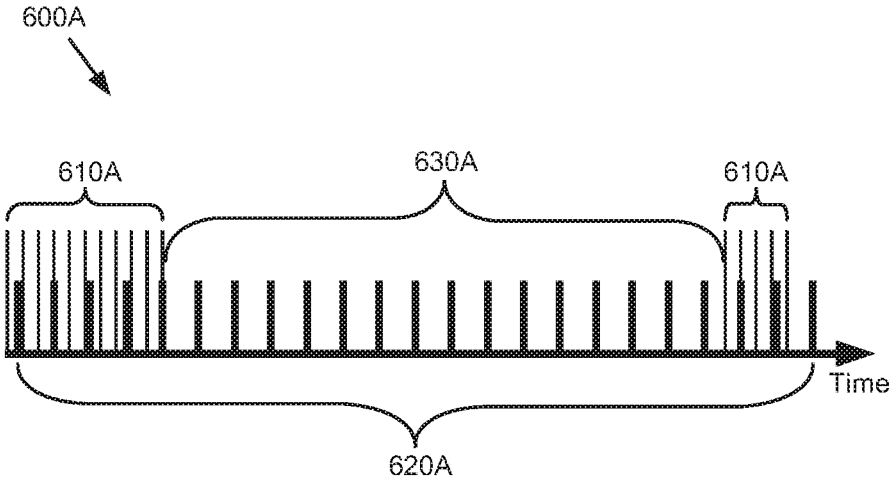
FIGS. 6A and 6B are schematic illustrations of example timing diagrams of operating a fluid ejection device.
Figure 6B:
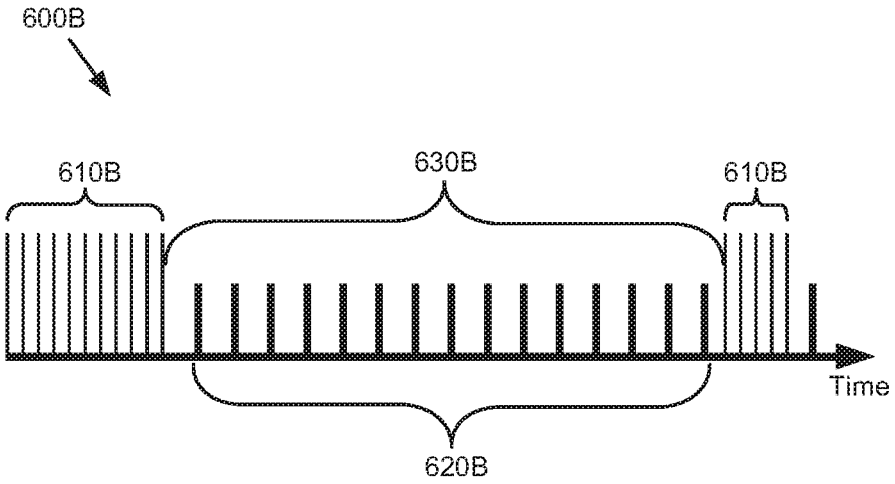

FIGS. 6A and 6B are schematic illustrations of example timing diagrams 600A and 600B, respectively, of operating a fluid ejection device, such as fluid ejection devices 200, 300, and 400 as described above and illustrated in the examples of FIGS. 2, 3, and 4. More specifically, timing diagrams 600A and 600B each provide for continuous circulation of fluid from fluid slots, such as fluid feed slots 208, 308, and 408, through fluid circulation channels, such as fluid circulation channels 220, 320, and 420, and respective fluid ejection chambers, such as fluid ejection chambers 202, 302, and 402, based on operation of respective fluid circulating elements, such as fluid circulating elements 222, 322, and 422.

In the examples illustrated in FIGS. 6A and 6B, timing diagrams 600A and 600B include a horizontal axis representing a time of operation (or non-operation) of a fluid ejection device, such as fluid ejection devices 200, 300, and 400. In timing diagrams 600A and 600B, taller, thinner vertical lines 610A and 610B, respectively, represent operation of the drop ejecting elements, such as drop ejecting elements 204, 304, and 404, and shorter, wider vertical lines 620A and 620B, respectively, represent operation of the fluid circulating elements, such as fluid circulating elements 222, 322, and 422. Operation of the drop ejecting elements (lines 610A, 610B) may include operation for nozzle warming and/or servicing as well as operation for printing.

In the examples illustrated in FIGS. 6A and 6B, a period of time between different or disassociated periods of operation of the drop ejecting elements (lines 610A, 610B) represents a decap time 630A and 630B, respectively, of the fluid ejection device. Decap time 630A and 630B, therefore, may include, for example, a period of time between nozzle warming/servicing and printing (and vice versa), and a period of time between a first printing operation, sequence or series (e.g., first print job) and a second printing operation, sequence or series (e.g., second print job).

As illustrated in timing diagram 600A, operation of the fluid circulating elements does not take into consideration (or is independent of) operation of the drop ejecting elements. More specifically, as illustrated by the nesting or overlap in the timing of operation of the fluid circulating elements (lines 620A) and the timing of operation of the drop ejecting elements (lines 610A), the operation of the fluid circulating elements (lines 620A) and, therefore, the circulation of fluid with timing diagram 600A, is not synchronized with (i.e., is asynchronous with) the operation of the drop ejecting elements (lines 610A). Namely, the operation of the fluid circulating elements occurs during periods of operation of the drop ejecting elements. Nonetheless, timing diagram 600A provides for continuous circulation of fluid during decap time 630A.

As illustrated in timing diagram 600B, operation of the fluid circulating elements does take into consideration (or is dependent on) operation of the drop ejecting elements. More specifically, the operation of the fluid circulating elements (lines 620B) and, therefore, the circulation of fluid with timing diagram 600B, is synchronized with (i.e., is synchronous with) the operation of the drop ejecting elements (lines 610B). Namely, the operation of the fluid circulating elements is limited to periods of non-operation of the drop ejecting elements. As such, timing diagram 600B provides for continuous circulation of fluid during decap time 630B.

As illustrated in the examples of FIGS. 6A and 6B, with timing diagrams 600A and 600B, a frequency of operation of the fluid circulating elements and, therefore, a frequency of the continuous circulation, is constant (substantially constant) during decap times 630A and 630B.

Figure 7:
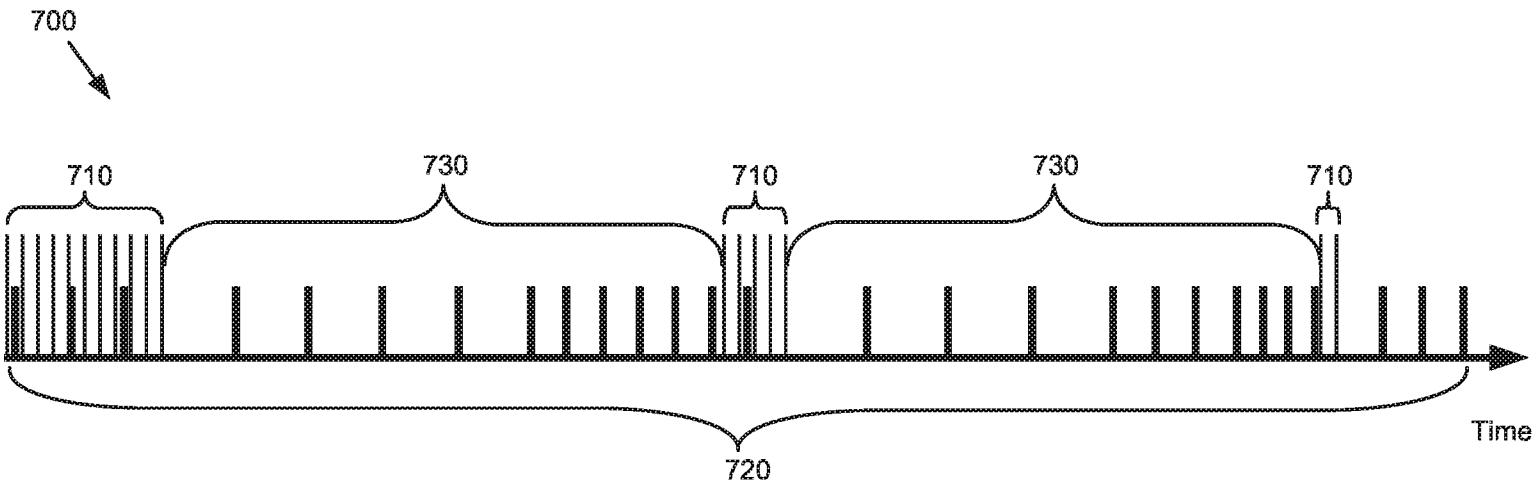
FIG. 7 is a schematic illustration of an example timing diagram of operating a fluid ejection device.

FIG. 7 is a schematic illustration of an example timing diagram 700 of operating a fluid ejection device, such as fluid ejection devices 200, 300, and 400 as described above and illustrated in the examples of FIGS. 2, 3, and 4. Similar to timing diagrams 600A and 600B as described above and illustrated in the examples of FIGS. 6A and 6B, timing diagram 700 provides for continuous circulation of fluid from a fluid slot, such as fluid feed slots 208, 308, and 408, through fluid circulation channels, such as fluid circulation channels 220, 320, and 420, and respective fluid ejection chambers, such as fluid ejection chambers 202, 302, and 402, based on operation of respective fluid circulating elements, such as fluid circulating elements 222, 322, and 422.

Similar to timing diagrams 600A and 600B, taller, thinner vertical lines 710 represent operation of drop ejecting elements, such as drop ejecting elements 204, 304, and 404, and shorter, wider vertical lines 720 represent operation of fluid circulating elements, such as fluid circulating elements 222, 322, and 422. In addition, similar to timing diagrams 600A and 600B, a period of time between different or disassociated periods of operation of the drop ejecting elements (e.g., nozzle warming/servicing and printing) represents a decap time 730 of the fluid ejection device.

In the example illustrated in FIG. 7, with timing diagram 700, a frequency of operation of the fluid circulating elements and, therefore, a frequency of the continuous circulation is variable. More specifically, a frequency of the continuous circulation is variable based on operation of the drop ejecting elements. The frequency of the continuous circulation may be variable with the example asynchronous timing diagram 600A of FIG. 6A, and/or may be variable with the example synchronous timing diagram 600B of FIG. 6B. As such, in either example, the frequency of the continuous circulation is variable during decap time 730.

In one example, the variable frequency of the continuous circulation is a function of an amount of time between disassociated periods of operation of the drop ejecting elements. More specifically, the variable frequency of the continuous circulation is a function of a length of decap time 730. For example, as illustrated in FIG. 7, as the decap time increases, the frequency of the continuous circulation increases.

In another example, the variable frequency of the continuous circulation is a function of an amount of operation of the drop ejecting elements. More specifically, the variable frequency of the continuous circulation is a function of a number of drops ejected by the drop ejecting elements. For example, as illustrated in FIG. 7, as the number of drops ejected by the drop ejecting elements decreases (represented, for example, by fewer vertical lines 710), the frequency of the continuous circulation increases. Conversely, as the number of drops ejected by the drop ejecting elements increases, the frequency of the continuous circulation decreases.

With a fluid ejection device including circulation as described herein, ink blockage and/or clogging is reduced. As such, decap time and, therefore, nozzle health are improved. In addition, pigment-ink vehicle separation and viscous plug formation are reduced or eliminated. Furthermore, ink efficiency is improved by lowering ink consumption during servicing (e.g., minimizing spitting of ink to keep nozzles healthy). In addition, a fluid ejection device including circulation as described herein, helps to manage air bubbles by purging air bubbles from the ejection chamber during circulation.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. A fluid ejection device, comprising:

a series of spaced two-sided walls forming three channels therebetween, each of the three channels containing a drop ejector; and a fluid circulating element to circulate fluid across the drop ejector within each of the channels.

2. The fluid ejection device of claim 1 further comprising:

a first fluid passage spanning across first ends of the two-sided walls;

a second fluid passage spanning across second ends of the two-sided walls, the fluid circulating element being sandwiched between the first fluid passage and the second fluid passage.

3. The fluid ejection device of claim 2, wherein one of the two-sided walls is sandwiched between the drop ejector and the fluid circulating element.

4. The fluid ejection device of claim 1, wherein the fluid circulating element is on one side of the three channels.

5. The fluid ejection device of claim 1 further comprising:

a second series of spaced two-sided walls forming a second series of three channels therebetween, each of the three channels, formed by the walls of the second series, containing a drop ejector; and a second fluid circulating element to circulate fluid across the drop ejector within each of the channels of the second series.

6. The fluid ejection device of claim 5 further comprising a fluid passage between the first series of two-sided walls and the second series of two-sided walls, the fluid passage spanning across ends of the first series of two-sided walls and across ends of the second series of two-sided walls.

7. The fluid ejection device of claim 6, wherein the first fluid circulation element and the second fluid circulation element are to receive fluid from the fluid passage.

8. The fluid ejection device of claim 7 further comprising a fluid feed slot opening within the fluid passage.

9. The fluid ejection device of claim 7, wherein the first series of two-sided walls is staggered along the fluid passage relative to the second series of two-sided walls.

10. The fluid ejection device of claim 5, wherein the second series of two-sided walls is parallel to the first series of two-sided walls.

11. The fluid ejection device of claim 10, wherein the second series of two-sided walls is staggered relative to the first series of two-sided walls.

12. The fluid ejection device of claim 11, wherein one of the two-sided walls of the second series of two-sided walls is centered with respect to the drop ejector contained within one of the three channels of the first series of two-sided walls.

13. The fluid ejection device of claim 1 comprising three adjacent U-shaped channel loopback portions extending around adjacent ends of the two-sided walls.

14. The fluid ejection device of claim 1, wherein the fluid circulating element comprises a thermal resistor.

15. The fluid ejection device of claim 1, wherein each drop ejector comprises a nozzle orifice centered between two of the two-sided walls.

16. The fluid ejection device of claim 1, wherein the drop ejector within each of the three channels is aligned with the drop ejector within each of the other of the three channels in a direction perpendicular to a direction of the three channels.

17. The fluid ejection device of claim 1, wherein the fluid circulating element is to provide continuous circulation of fluid that continually spans both a decap time and a non-decap time of the drop ejecting element.

18. A fluid ejection device comprising:

a first series of spaced walls comprising a first wall, a second wall and a third wall;

a first drop ejector between the first wall and the second wall;

a second drop ejector between the second wall and the third wall;

a second series of spaced walls comprising a fourth wall, a fifth wall and a sixth wall;

a third drop ejector between the fourth wall and the fifth wall;

a fourth drop ejector between the fifth wall and the sixth wall, wherein the second series of spaced walls extends parallel to the first series of spaced walls and wherein the first series of spaced walls is staggered relative to the second series of spaced walls.

19. The fluid ejection device of claim 18 further comprising a fluid circulation element to circulate fluid across the first drop ejector and the second drop ejector.

20. A method of operating a fluid ejection device, the method comprising:

inducing fluid flow, with a fluid circulating element, along consecutive first ends of a series of at least three two-sided walls spaced by channels;

inducing fluid flow across a drop ejector within each of the channels;

inducing fluid flow along consecutive second ends of the series of the at least three two-sided walls from each of the channels to the fluid circulating element.

* * * * *